US006872882B2

(12) United States Patent
Fritz

(10) Patent No.: US 6,872,882 B2
(45) Date of Patent: Mar. 29, 2005

(54) AREAL ELECTRIC CONDUCTOR COMPRISING A CONSTRICTION

(75) Inventor: Andreas Fritz, Markt Indersdorf (DE)

(73) Assignee: W.E.T. Automotive Systems AG (DE)

( * ) Notice: Subject to any disclaimer, the term of this patent is extended or adjusted under 35 U.S.C. 154(b) by 0 days.

(21) Appl. No.: 10/197,481

(22) Filed: Jul. 16, 2002

(65) Prior Publication Data

US 2003/0010773 A1 Jan. 16, 2003

(30) Foreign Application Priority Data

Jul. 16, 2001 (DE) ..... 101 34 515

(51) Int. Cl.[7] ..... H01B 7/34; H01B 7/00
(52) U.S. Cl. ..... 174/36; 174/110 R; 174/117 FF
(58) Field of Search ..... 174/94 R, 117 R, 174/117 F, 117 FF, 36, 126.1; 338/212; 219/488.19, 525, 538, 539, 541, 542, 548, 228, 229

(56) References Cited

U.S. PATENT DOCUMENTS 3,665,598 A * 5/1972 Brieko ..... 29/611
3,975,690 A * 8/1976 Fleming ..... 330/5
4,831,421 A * 5/1989 Gallagher et al. ..... 257/34
5,824,996 A * 10/1998 Kochman et al. ..... 219/529
5,956,073 A * 9/1999 Jin et al. ..... 725/105
6,124,575 A * 9/2000 Black ..... 219/465.1
6,194,692 B1 * 2/2001 Oberle ..... 219/543
6,522,236 B1 * 2/2003 Ries ..... 338/13

FOREIGN PATENT DOCUMENTS

DE 3428510 A * 2/1986 ..... H01H/85/10
DE WO 93/21430 * 10/1993 ..... F01N/3/20

* cited by examiner

*Primary Examiner*—William H. Mayo, III

(57) ABSTRACT

An electrical conductor including an areal conductor having a constricted current path region along a length thereof is described, in which an accessory conductor bridges the constricted current path region along the length of the areal conductor such that a substantially uniform current density exists throughout the electrical conductor. In this way, current hot spots in the region of the current path constriction are avoided. The constricted current path region may be defined by two lengthwise edges of the areal conductor and the accessory conductor may include two circular or parabolic contours, each opposing and spaced apart from a respective edge of the areal conductor defining the constricted current path region.

18 Claims, 2 Drawing Sheets

AREAL ELECTRIC CONDUCTOR COMPRISING A CONSTRICTION

TECHNICAL FIELD

The invention relates to a flat surface or areal electric conductor, for example a heating conductor, and in particular to an areal conductor having a constriction along the length thereof.

BACKGROUND OF THE INVENTION

In areal electrical conductors, for reasons of design, it is often necessary to provide a constriction in the conductive part of the cross-section of the conductor. In the constricted region of the areal electrical conductor, owing to the increased current density, undesirable overheating, or so-called "hot spots," may occur. Accordingly, there is a need for an improved areal electrical conductor having reduced hot spot tendencies. That is, there is a need for a flat surface conductor having a uniform current density throughout the constricted and non-constricted regions.

SUMMARY OF THE INVENTION

An object of the invention, therefore, is to reduce or eliminate such hot spots in areal electric conductors by providing a constricted areal electrical conductor having a substantially uniform current density across its surface including the region of the constriction.

The present invention provides an areal electrical conductor having a constricted region and a substantially uniform current density across its surface including in the region of the constriction. According to the invention, an accessory conductor is provided which bridges the constricted region in the lengthwise direction of the conductor.

In one aspect of the invention, an electrical conductor including a substantially planar areal conductor having a constricted current path region along a length thereof, and an accessory conductor bridging the constricted current path region along the length of the areal conductor is provided such that a substantially uniform current density exists throughout the electrical conductor.

In another aspect of the invention, an electrical conductor including a generally flat areal conductor having a constricted current path region along a length thereof between a first and second region each having a substantially equal current density is provided. An accessory conductor bridges the constricted current path region along the length of the areal conductor such that a substantially uniform current density exists throughout the first and second regions and the constricted current path region. The constricted current path region may be defined by two lengthwise edges of the areal conductor and the accessory conductor may include two circular or parabolic contours, each opposing a respective edge of the areal conductor defining the constricted current path region.

Further, a conductor assembly is provided. The assembly includes a generally planar areal conductor having a substantially uniform width along a length thereof and including a constricted region defined by a lengthwise edge of the areal conductor, and an accessory conductor electrically coupled and attached to the areal conductor across the constricted region. The accessory conductor includes a contoured edge spaced apart from and opposing the lengthwise edge of the areal conductor defining the constricted region. The contoured edge is configured to provide a substantially uniform current density throughout the conductor assembly.

The accessory conductor is preferably likewise an areal electrical conductor, applied all over the constricted areal electrical conductor and, at least, in the region of the constriction. For example, the accessory electrical conductor may be soldered, welded, bonded by way of a conductive glue, or sewn on the constricted conductor if the constricted conductor and the accessory conductor are made of textile material.

The outer contour of the accessory conductor is preferably chosen such that as uniform a current density as possible in the constricted conductor and in the accessory conductor will result. Preferably, the outer contour of the accessory conductor is circular or parabolic on the side opposing the constricted region.

In the case of a constriction of the path of current by recesses arranged on either edge of the areal electrical conductor, both of the outer contours of the accessory conductor extending in the lengthwise direction of the constricted conductor may be circular or parabolic.

Preferably, the accessory conductor, especially in the region of the constriction of the current path in the constricted conductor, is arranged at a distance from at least one edge of the constricted conductor.

The accessory conductor itself may also be a heating element.

Preferred embodiments of the invention are illustrated in the drawings and will be described below by way of examples of the invention. Other advantages and features of the invention will become apparent upon reading the following detailed description and appended claims, and upon reference to the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention. In the following, two embodiments of an areal electric conductor according to the invention will be illustrated by way of example.

In the drawings.

DETAILED DESCRIPTION OF THE INVENTION

While the present invention is described with respect to a surface heating element, the present invention may be adapted and utilized for any flat, surface-type conductors wherein the cross-sectional width of the conductor is non-uniform, i.e. the conductor includes at least one constricted region along its length.

In the following description, various features and components are described from two constructed embodiments. These features and components are included as examples and are not meant to be limiting.

Figure 1:
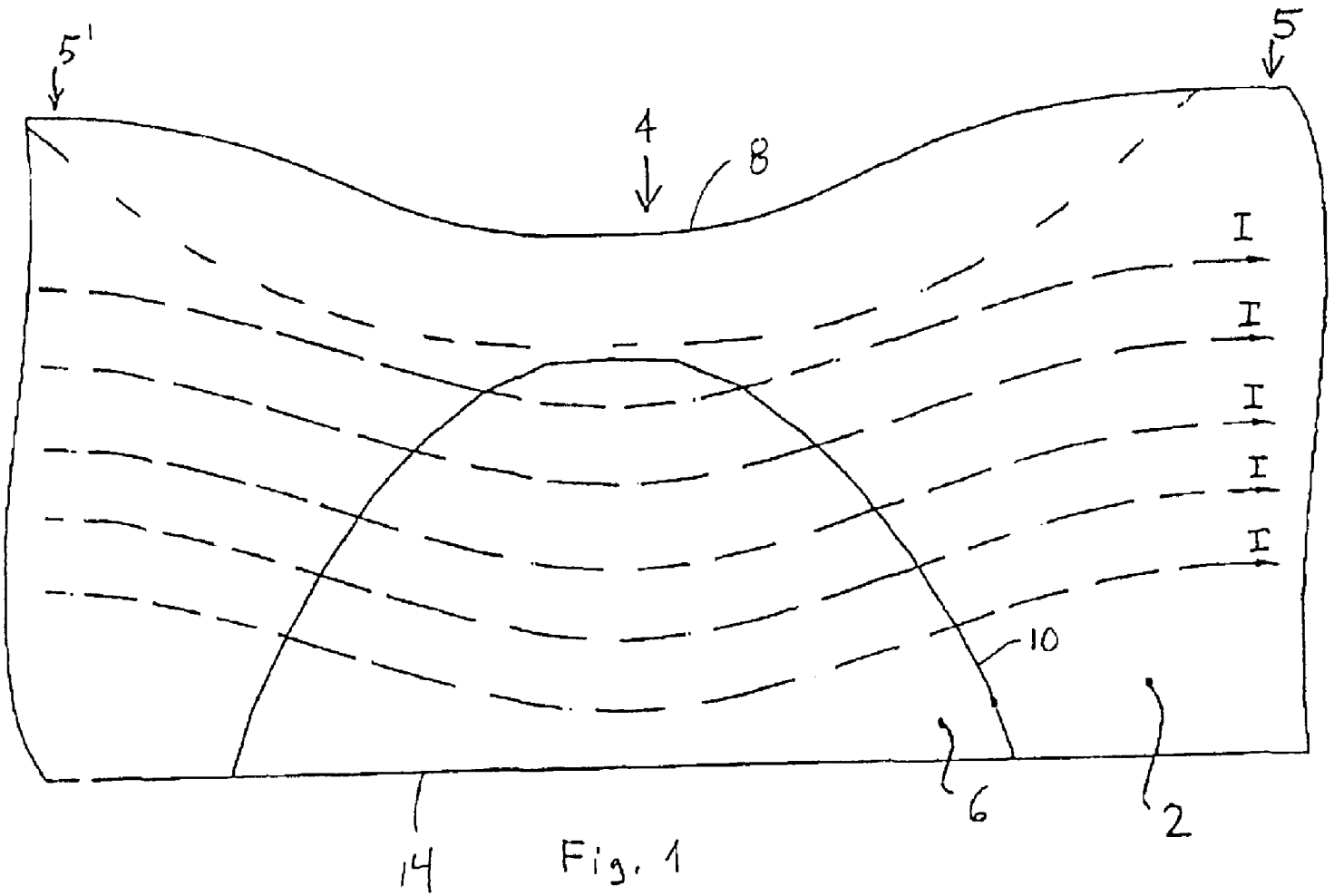
FIG. 1 shows the top view of an areal electric conductor with an accessory conductor for a unilateral constriction in accordance with one embodiment of the present invention.

Referring now to the drawings wherein like reference numerals are used to identify identical components in the various views, FIG. 1 shows a top view of a conductor assembly including an areal electrical conductor 2 with an accessory conductor 6 according to one embodiment of the present invention. The areal conductor 2 is a generally flat, surface-type electrical conductor. The areal conductor 2 can be made of a metalized textile, or a textile with carbon fibers, or a metalized film. Other known types of areal conductors are also contemplated by the present invention.

Along its length, the areal conductor 2 has a substantially constant width represented by regions 5 and 5'. Between the regions 5, 5' there is a current path constriction in region 4. As can be seen in FIG. 1, the current paths I result in an increased current density in the region of the constriction 4 of the areal conductor 2. The region 4 of the current path constriction may or may not coincide with a physical constriction along the edge 8 of the areal conductor 2 depending upon the configuration of the conductive elements in the areal conductor. In the example of FIG. 1, however, the constricted region 4 is along one edge 8 of the areal conductor 2.

Overlapping the constricted region 4, in the lengthwise direction, an accessory conductor 6 is applied to the areal conductor 2. The accessory conductor 6, being electrically conductive and electrically coupled to the areal conductor 2, takes up part of the current flowing through the areal conductor 2 and, thus, prevents the occurrence of a hot spot. As a result of the accessory conductor 6, the current density in the region of the constriction 4 is substantially uniform. The outer contour 10 of the accessory conductor 6 on the side extending into the areal conductor 2 (opposing the constricted edge 8) is generally circular or parabolic, so that a uniform distribution of the current over the cross-section of the areal conductor 2 and accessory conductor 6 will result. The other side 14 of the accessory conductor 6 is generally aligned with the unconstricted edge of the areal conductor. The outer contour 10 of the accessory conductor 6, in the region of the constriction 4, is spaced apart from the edge 8 of the areal conductor 2.

The accessory conductor 6 may likewise be made of a metalized textile, textile with carbon fibers, metalized film, or other surface conductor, including a heating element. The accessory conductor 6 can be soldered, welded, bonded by way of conductive glue, or sewn on the constricted conductor 2 if the constricted conductor 2 and the accessory conductor are made of textile materials. The accessory conductor is applied over the entire surface of the areal conductor 2 in the region of the constriction 4.

Figure 2:
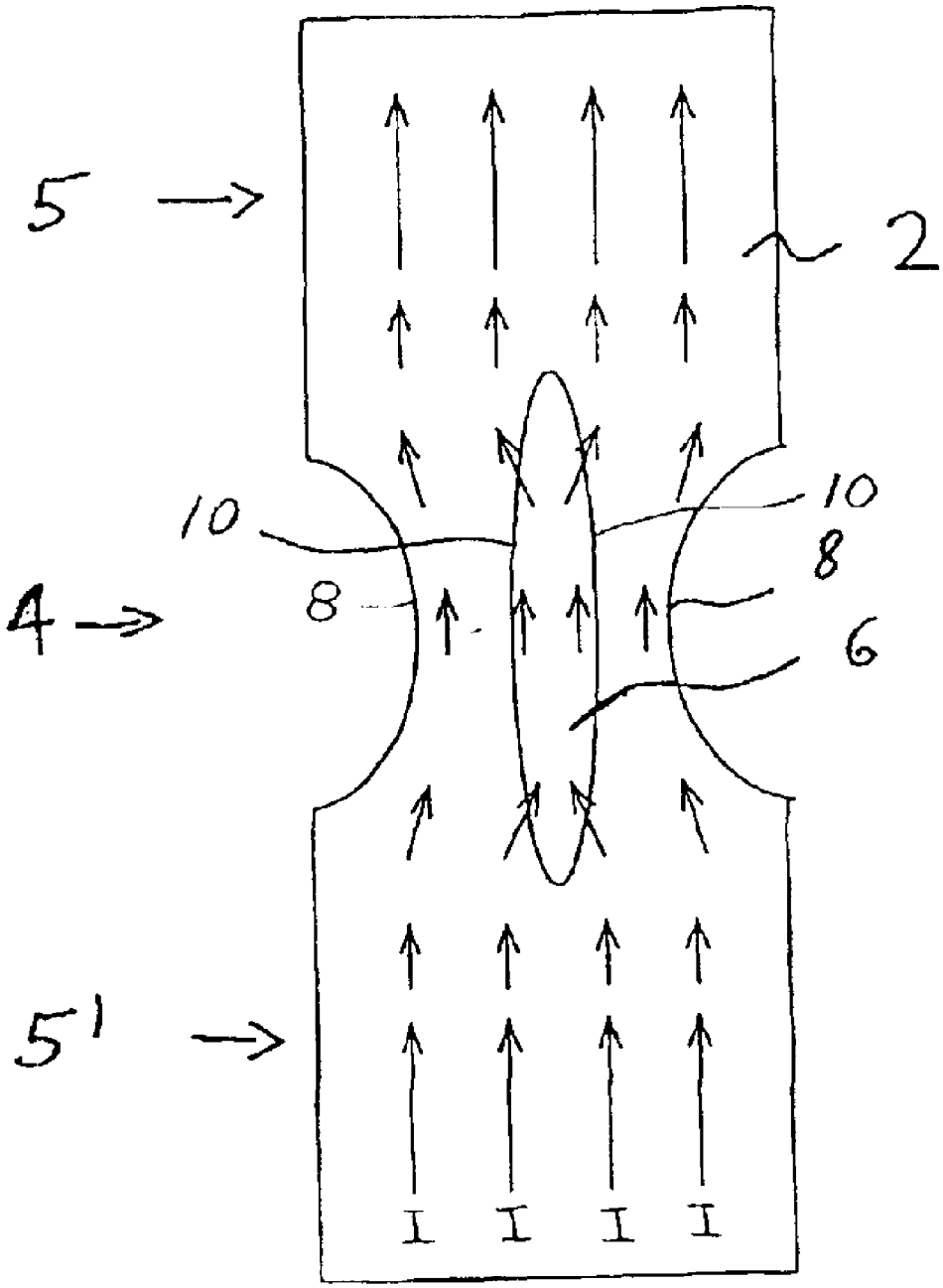
FIG. 2 shows the top view of an areal electric conductor with an accessory conductor for a bilateral constriction of the conductor in accordance with another embodiment of the present invention.

In the example of FIG. 2, there is shown an areal conductor 2 having a bilateral constriction in the region 4. Here, the accessory conductor 6 has a bilateral circular or parabolic outer contour 10, resulting in more or less the contour of a shuttle. Again, the contoured edges 10 are spaced apart from the constricted edges 8 of the areal conductor 2.

By virtue of the accessory conductor according to the invention, hot spots in such areal electric conductors are avoided. The accessory conductor provides a material of low resistance by which the current density becomes more uniform throughout the entirety of the areal conductor 2.

From the foregoing, it can be seen that there has been brought to the art a new and improved surface conductor. While the invention has been described in connection with one or more embodiments, it should be understood that the invention is not limited to those embodiments. Thus, the invention covers all alternatives, modifications, and equivalents as may be included in the spirit and scope of the appended claims.

What is claimed is:

1. An electrical conductor comprising a substantially planar areal conductor having a constricted current path region along a length thereof, and an accessory conductor bridging the constricted current path region along the length of the areal conductor such that a substantially uniform current density exists throughout the electrical conductor.

2. An electrical conductor according to claim 1 wherein the accessory conductor comprises a contoured edge opposing an edge defining the constricted current path region of the areal conductor.

3. An electrical conductor according to claim 2 wherein the contoured edge of the accessory conductor is circular or parabolic.

4. An electrical conductor according to claim 3 wherein the contoured edge of the accessory conductor, in the region of the current path constriction, is spaced outwardly from the edge defining the constricted current path region of the areal conductor.

5. An electrical conductor according to claim 2 wherein the contoured edge of the accessory conductor, in the region of the current path constriction, is spaced outwardly from the edge defining the constricted current path region of the areal conductor.

6. An electrical conductor according to claim 1 wherein the accessory conductor, in the region of the current path constriction, is spaced outwardly from at least one edge of the areal conductor.

7. An electrical conductor according to claim 1 wherein the areal conductor is a heating element.

8. An electrical conductor according to claim 7 wherein the accessory conductor is a heating element.

9. An electrical conductor comprising a generally flat areal conductor having a constricted currant path region along a length thereof between a first and second region each having a substantially equal current density, and an accessory conductor bridging the constricted current path region along the length of the areal conductor, the combined constricted current path region and accessory conductor having a current density substantially equal to the first and second regions.

10. An electrical conductor according to claim 9 wherein the constricted current path region is defined by an edge of the areal conductor and wherein the accessory conductor comprises a circular or parabolic contour opposing the edge of the areal conductor defining the constricted current path region.

11. An electrical conductor according to claim 10 wherein the contour of the accessory conductor is spaced outwardly from the edge of the areal conductor defining the constricted current path region.

12. An electrical conductor according to claim 9 wherein the constricted current path region is defined by two lengthwise edges of the areal conductor and wherein the accessory conductor comprises two circular or parabolic contours, each opposing a respective edge of the areal conductor defining the constricted current path region.

13. An electrical conductor according to claim 12 wherein each contour of the accessory conductor is spaced outwardly from the respective edge of the areal conductor defining the constricted current path region.

14. An electrical conductor according to claim 9 wherein the areal conductor and the accessory conductor comprise at least one of a metalized textile, a textile having carbon fibers, or a metalized film.

15. A conductor assembly comprising:

a generally planar areal conductor having a substantially uniform width along a length thereof and including a constricted region defined by a lengthwise edge of the areal conductor; and an accessory conductor electrically coupled and attached to the areal conductor bridging the constricted region, the accessory conductor including a contoured edge spaced outwardly from and opposing the lengthwise edge of the areal conductor defining the constricted region, wherein the contoured edge is configured to provide a substantially uniform current density throughout the conductor assembly.

16. A conductor assembly according to claim 15 wherein the contoured edge is circular or parabolic in shape.

17. A conductor assembly according to claim 15 wherein two lengthwise edges of the areal conductor define the constricted region, and wherein the accessory conductor comprises two contoured edges each spaced apart from and opposing a respective edge of the areal conductor defining the constricted region.

18. A conductor assembly according to claim 15 wherein the areal conductor and the accessory conductor comprise at least one of a metalized textile, a textile having carbon fibers, or a metalized film.

* * * * *